US006098039A

United States Patent [19]

Nishida

[11] Patent Number: 6,098,039

[45] Date of Patent: Aug. 1, 2000

[54] AUDIO ENCODING APPARATUS WHICH SPLITS A SIGNAL, ALLOCATES AND TRANSMITS BITS, AND QUANTITIZES THE SIGNAL BASED ON BITS

[75] Inventor: Fumiaki Nishida, Kawasaki, Japan

[73] Assignee: Fujitsu Limited, Kanagawa, Japan

[21] Appl. No.: 09/094,742

[22] Filed: Jun. 15, 1998

[30] Foreign Application Priority Data

Feb. 18, 1998 [JP] Japan ..... 10-035876

[51] Int. Cl.[7] ..... G10L 21/00

[52] U.S. Cl. ..... 704/229; 704/500; 704/501

[58] Field of Search ..... 704/500–504, 704/229

[56] References Cited

U.S. PATENT DOCUMENTS

| | | | |
|---|---|---|---|
| 5,508,949 | 4/1996 | Konstantinides . | |
| 5,890,124 | 3/1999 | Galbi | 704/501 |
| 5,956,674 | 9/1999 | Smyth et al. | 704/229 |
| 5,974,380 | 10/1999 | Smyth et al. | 704/229 |
| 5,978,762 | 11/1999 | Smyth et al. | 704/229 |
| 5,987,418 | 11/1999 | Gentit | 704/500 |
| 6,023,490 | 2/2000 | Ten Kate | 375/240 |
| 6,029,126 | 2/2000 | Malvar | 704/204 |
| 6,032,081 | 2/2000 | Han et al. | 700/94 |

FOREIGN PATENT DOCUMENTS 537395 2/1993 Japan .

OTHER PUBLICATIONS

Internation Standard ISO/IEC 11172–3, pp. 20–32, pp. 70–75, Aug. 1, 1993.

Digital Signal Processing Handbook, Madisetti et al, chapter 40, pp. 1–9, 1998.

*Primary Examiner*—Krista Zele
*Assistant Examiner*—Michael N. Opsasnick
*Attorney, Agent, or Firm*—Helfgott & Karas, P.C.

[57] ABSTRACT

Disclosed is an audio encoding apparatus for splitting an audio signal into a plurality of bands, allocating a number of quantization bits to each band and transmitting the audio signal of each band upon quantizing the audio signal by the number of allocated bits. The apparatus includes a bit allocation unit for (1) calculating an MNR for each band, where MNR is the ratio of an audio masking level M to a quantization noise level N, (2) comparing a set MNR with the smallest MNR from among the MNRs of the respective bands, (3) incrementing the number of quantization bits of the band that corresponds to the smallest MNR if the smallest MNR is smaller than the set MNR, and (4) performing allocation control for allocating quantization bits to each band until the smallest MNR becomes equal to or greater than the set MNR. A quantizer quantizes the audio signal of each band by the allocated number of quantization bits, and a bit-rate calculation unit decides a bit rate for transmission of audio data based upon the number of quantization bits allocated to each band.

6 Claims, 14 Drawing Sheets

FIG.2

| NUMBER OF BITS ALLOCATED TO EACH BAND | SNR VALUE (dB) |
|---|---|
| 0 | 0.00 |
| 2 | 7.00 |
| 3 | 16.00 |
| 4 | 25.28 |
| 5 | 31.59 |
| 6 | 37.75 |
| 7 | 43.84 |
| 8 | 49.89 |
| 9 | 55.93 |
| 10 | 61.96 |
| 11 | 67.98 |
| 12 | 74.01 |
| 13 | 80.03 |
| 14 | 86.05 |
| 15 | 92.01 |

FIG.3

| BIT RATE (kbps) | NUMBER OF BITS PER FRAME (bit) |
|---|---|
| 32 | 768 |
| 48 | 1152 |
| 56 | 1344 |
| 64 | 1536 |
| 80 | 1920 |
| 96 | 2304 |
| 112 | 2688 |
| 128 | 3072 |
| 160 | 3840 |
| 192 | 4608 |
| 224 | 5376 |
| 256 | 6144 |
| 320 | 7680 |
| 384 | 9216 |

FIG.5 PRIOR ART

| INPUT SIGNAL | AVERAGE MNR VALUE (dB) |
|---|---|
| 1 . SIGNAL APPROXIMATING ALMOST TOTAL SILENCE | 23.45 |
| 2. WHITE NOISE 1 (LOW LEVEL) | 15.84 |
| 3. WHITE NOISE 2 (MEDIUM LEVEL) | 12.67 |
| 4. WHITE NOISE 3 (HIGH LEVEL) | 10.12 |

QUANTIZATION BIT COUNT ↑ HIGH ↓ LOW

FIG.6 PRIOR ART

| INPUT SIGNAL | AVERAGE MNR VALUE (dB) |
|---|---|
| 5. 1 kHz SINE WAVE | 62.75 |
| 6. 7kHz SINE WAVE | 76.93 |
| 7. 15 kHz SINE WAVE | 262.00 |

AUDIO ENCODING APPARATUS WHICH SPLITS A SIGNAL, ALLOCATES AND TRANSMITS BITS, AND QUANTITIZES THE SIGNAL BASED ON BITS

BACKGROUND OF THE INVENTION

This invention relates to an audio encoding apparatus and, more particularly, to an audio encoding apparatus for splitting an audio signal into a plurality of bands, allocation the number of quantization bits for each band and transmitting the audio signal of each band upon quantizing the audio signal by the allocated number of bits.

An example of an apparatus that employs highly efficient encoding of acoustic (audio) signals is remote monitoring apparatus that multiplexes audio and video and transmits them in one direction in real-time. Such a remote monitoring apparatus makes it possible to monitor a situation by way of dynamic images and sound (audio) without requiring that an individual make rounds for inspection. Such an apparatus has a variety of applications. For example, by deploying such an apparatus at a plurality of stores, conditions within the stores can be monitored collectively at the main office. By deploying the apparatus at various points along a road, traffic tie-ups along the road can be ascertained. Another application besides use as a remote monitoring apparatus is a TV conferencing system, in which two-way communication is required.

FIG. 11 is a diagram showing the configuration of a remote monitoring system. The system includes a decoding unit 1 serving as a central monitor provided at a monitoring center, and an encoding unit 2 serving as a monitor provided at a location where monitoring is required. A number of the encoding units 2 are provided and are capable of transmitting audio and video to the central monitoring unit 1 via transmission lines 3. The encoding unit 2 includes input devices such as a camera 2*a* and microphone 2*b* for entering video and sound (audio) signals, respectively, an image encoder 2*c* and an audio encoder 2*d* for compressing the video and audio signals, respectively, and a multiplexer (MUX) 2*e* for multiplexing the compressed video and audio signals. The multiplexed signals are transmitted to another unit (the decoding unit 1) via the transmission line 3. The decoding unit 1 includes a demultiplexer (DEMUX) 1*a* for demultiplexing the compressed signals, which have been transmitted from the encoding unit side, into video and audio signals, and a video decoder 1*b* and audio decoder 1*c* for decompressing the compressed video and audio signals, respectively. The decompressed video and audio signals are output from output devices such as a monitor 1*d* and speaker 1*e*, respectively.

Compression employs 32 subband encoding (band-splitting encoding) as the technique for highly efficient encoding of audio signals and utilizes a psychoacoustic characteristic to realize highly efficient compression. The human ear cannot hear sounds below a certain level. A characteristic curve obtained by plotting this level for each and every band is referred to as a minimum masking threshold value curve (minimum audible threshold curve) MTC (see FIG. 12). The masking effect varies depending upon the conditions of sound in the surrounding area and small sounds cannot be heard because of large sounds even if the sound has a level greater than the minimum masking threshold value curve MTC. The reason for this is that the masking threshold value curve is changed by large sounds, as indicated by MTC' in FIG. 12. Sound components A, B below this curve are masked and are inaudible to the human ear. Components C, D extending beyond the masking threshold value curve MTC' can be heard.

In view of the foregoing, the sounds A, B below the masking threshold value level MTC' are not quantized but the sounds C, D above the masking threshold value level are. In case of quantization, this is carried out upon allocating numbers of quantization bits in dependence upon the difference between an audio level S and masking threshold value level M in each subband. The quantized data and the numbers of bits allocated are output.

More specifically, as shown in FIG. 13, one frame is constituted by audio signals in 36 sub-frames (one sub-frame consists of 32 samples), the audio signal of each sub-frame is subdivided into 32 subbands, and subband encoding of 32 bands is carried out. That is, the entire band is split into 32 equally spaced frequency widths, each sample signal is encoded by being quantized in dependence upon the number of quantization bits of each subband (described later), and 1152 (=36×32) items of sample data are adopted as one frame.

One scale factor is decided in common for 36 items of sample data of one subband sbi (i=0–31). In other words, normalization is performed in such a manner that the maximum value of each of 36 waveforms will become 1.0, and the normalization scale factor is encoded as the scale factor.

Further, the number of quantization bits of each subband sbi is decided and adopted as the number of allocated bits. The masking effect can be utilized most effectively by specifying the quantization precision (number of quantization bits) to the very limit of the masking level that takes the width of the critical band into account. Masking makes it possible to completely eliminate information concerning a band that contains only signals whose level cannot be sensed by the auditory system. In such case bits are not allocated as sample data. In other words, sampling data is non-existent in a case where the number of quantization bits of sample data in each subband is zero.

FIG. 14 is a diagram useful in describing the structure of one frame of an audio bit stream. Numeral 10 denotes the smallest unit capable of being decoded into an audio signal individually. The smallest unit 10 always includes data of a fixed number of samples, i.e., 1152 (=36×32). The smallest unit 10 is composed of a 32-bit header 11, an error-check code (optional) 12 and an audio data field 13. The audio data field 13 has a quantization bit count 13*a*, a scale factor 13*b* and sample data 13*c*. The header 11 includes a 12-bit all "1"s synchronization word 11*a*, an ID 11*b* that is always "1", a layer identification 11*c* and information such as a bit-rate index, sampling frequency and mode.

The audio data field 13 has the structure shown in FIG. 15. The quantization bit count 13*a* indicates the number Bi of quantization bits in each of 36 items of sampling data in each subband sbi (i=0–31), and the scale factor 13*b* indicates the normalization scale factors of those items of sampling data in each subband sbi (i=0–31) for which the numbers of quantization bits are other than zero. Each item of sampling data of a subband sbi for which the quantization bit count is not zero is multiplied by the corresponding scale factor Si and the product is quantized by the quantization bit count Bi to obtain the sample data 13*c*.

FIG. 16 is a diagram showing the construction of an audio encoder according to the prior art. The encoder includes a band splitting filter 21 for splitting an input audio signal into a signal of n frequency bands (e.g., n=32 subbands), and a psychoacoustic model 22 constituted by an FFT analyzer. The psychoacoustic model 22 obtains the masking threshold value characteristic MTC' (described above in connection with FIG. 12) whenever audio signals of m samples per frame (m=32×36=1152) enter, and calculates an SMR (signal-to-mask ratio) for every subband sbi (i=0–31) from the masking level M and signal level S in each subband sbi of the masking threshold value characteristic MTC' . The SMR is the ratio of signal level S to masking level M and is measured in decibels, obtained by 10 log(S/M).

The encoder further includes a bit allocator 23 for allocating the quantization bit count Bi to each band sbi (i=0–31) in accordance with bit allocation processing, described later. The bit allocator 23 calculates an MNR (mask-to-noise ratio) of each band based upon the SMR of each band sbi output by the psychoacoustic model 22 and increments the quantization bit number of the band having the smallest MNR (i.e., performs the operation Bi+1→+Bi). The MNR is the ratio of masking level M to quantization noise and is measured in decibels, obtained by 10 log(M/N). The larger the quantization noise N, i.e., the smaller the number of quantization bits, the smaller the value of MNR. The smaller the quantization noise N, i.e., the larger the number of quantization bits, the greater the value of MNR. Further, the quantization noise N is decided by the number of quantization bits. If the number of quantization bits is known, therefore, the SNR [=10 log(S/N)] of the audio signal level S to the quantization noise level N will be known.

Thus, if the SMR of a band of interest is subtracted from the SNR obtained from the quantization bit number of this band, the MNR of the band of interest can be calculated. In other words, MNR can be calculated as follows:

$$MNR = 10\log(S/N) - 10\log(S/M) \quad (1)$$
$$= 10\log(M/N)$$

The bit allocator 23 repeats calculation of the MNR of each band, determination of the smallest MNR and processing for incrementing the quantization bit count of the band having this smallest MNR until it distributively allocates the total number A of bits per frame, obtained from the number of quantization bits of the band of interest, to all bands $sb_0$–$sb_{31}$. When the total number A of bits per frame have been distributively allocated to all bands, control for allocation of the quantization bit numbers to the bands $sb_0$–$sb_{31}$ is terminated.

The audio encoder further includes an encoding unit 24 for encoding the quantization bit count (the number of allocated bits) of each band, and a bit-rate setting unit 25 for setting the bit rate from an external unit in advance. A total of 14 bit rates (32–448 kbps) are stipulated and the prescribed bit rate is set. A scale factor computing unit 26 calculates one scale factor Si in common for 36 items of sample data in each band sbi (i=0–31). The scale factor computing unit 26 performs normalization in such a manner that the maximum value of each of 36 waveforms will become 1.0, and calculates the normalization scale factor as the scale factor. An encoding unit 27 codes this scale factor. The results obtained by multiplying each of the 36 items of sample data of each band sbi by the scale factor Si of the band are applied to a quantizer 28. The latter quantizes these results by the quantization bit count Bi of the band. The quantized data, scale factor and quantization bit count that have been encoded are applied to a bit multiplexer 29, which multiplexes the bits of these inputs and transmits them as a bit stream at the set bit rate.

The band dividing filter 21 splits the input audio signal into a signal of n frequency bands (e.g., n=32), and the psychoacoustic model 22 calculates the SMR for each of the n bands $sb_0$–$sb_{31}$ upon taking into account the masking effect, which is the auditory characteristic of the human ear. The bit allocator 23 calculates the MNR of each band in accordance with Equation (1) based upon the SMR of each of the n bands $sb_0$–$sb_{31}$. Next, the bit allocator 23 calculates the number A of bits per frame from the bit rate set by the bit-rate setting unit 25 and allocates quantization bits one bit at a time to the band indicating the smallest MNR until the total number of allocated bits attains the bit count A. The scale factor computing unit 26 calculates the scale factor using 36 items of sample data of each band sbi (i=0–31) resulting from band splitting by the band splitting filter 21, and the quantizer 28 quantizes each sample signal of each band sbi using the scaling factor Si (i=0–31) and quantization bit count Bi (i=1–31). The bit multiplexer 29 multiplexes (1) the quantization code, which is the output of the quantizer, (2) the code obtained by encoding the output (scale factor) of the scale factor computing unit 26, and (3) the code obtained by encoding the bit allocation information, and transmits these codes in the form of a bit stream based upon the bit rate set by the bit-rate setting unit 25.

FIG. 17 is a diagram useful in describing bit allocation by the bit allocator 23 according to the prior art. Components in FIG. 17 identical with those shown in FIG. 16 are designated by like reference characters. Shown in FIG. 17 are the psychoacoustic model 22, the bit allocator 23 and the bit-rate setting unit 25.

When an audio signal enters the psychoacoustic model 22, the latter calculates the SMR value of each band sbi (i=0–31) taking into count the auditory characteristic of the human ear. Using the calculated SMR of each band, the bit allocator 23 allocates bits for quantization to each band sbi (i=0–31). More specifically, the bit allocator 23 calculates the number A of allocable bits per frame from the bit rate set by the bit-rate setting unit 25 (i.e., from one of the 14 bit rates of 32–447 kbps) (step 101). Highly efficient audio encoding is a method of processing audio signals in a certain, fixed mass, which is referred to as a frame. By way of example, one frame consists of 36 sub-frames by 32 subbands. The length of time used for one frame generally is 20–40 ms because it is believed that there will be no significant change in sonic quality during this period of time. The number A of bits per one such frame is calculated in accordance with the following equation:

$$A = \text{set bit rate} \times \text{frame length} \quad (2)$$

Accordingly, if we let Fs (kHz) represent the sampling frequency and Br (Kbps) the bit rate, then Equation (2) may be written $$A = \text{Br} \times (32 \times 36/Fs) \quad (2)'$$

In actuality, the number of bits allocated as the quantization bits is the number obtained by subtracting, from the bit count A, the number of bits needed for reporting the scale factor and number of quantization bits of each band.

Next, the bit allocator 23 calculates the MNR of each band sbi (i=0–31) in accordance with Equation (1) (step 102). When the MNR of each band sbi has been obtained, then the bit allocator 23 searches these MNRs for the smallest MNR (step 103) and increments the number of quantization bits in the band having the smallest MNR (step 104). More specifically, the quantization bit count Bi (i=0–31) is stored in memory means 23*a* for each band sbi (i=0–31) and the quantization bit count of the band conforming to the smallest MNR is incremented (Bi+1→Bi)

Next, the bit allocator 23 subtracts 36 from the allocable number of bits per frame (step 105). The reason for subtracting 36 is that there are 36 items of sampling data per band and the quantization bit count of each item of sampling data is incremented by one.

Thus, since the number of allocated bits has changed, the MNR of each band sbi is calculated again (step 106). Next, the bit allocator 23 compares the number A of allocable bits per frame with zero (step 107). If A is equal to or greater than zero, then loop processing from step 103 onward is repeated. If A is less than zero, then the bit allocator 23 adopts the immediately preceding number of allocated bits stored in the memory means 23*a* of each band sbi (i=0–31) as the final quantization bit count Bi (i=0–31).

Up to 14 bit rates (32–448 kbps) are stipulated for highly efficient coding of audio. The state of the art is such that if highly efficient encoding processing is applied to an audio encoder and an audio decoder, the bit rate allocated to video and the bit rate allocated to audio are each fixed, and the overall bit rate is the sum of the video and audio bit rates. The encoded video and audio data is transmitted at this bit rate.

An audio encoding apparatus for remote monitoring of stores and roads encodes and transmits even audio signals having little importance (audio signals during quiet periods or noisy periods in which there is much noise from the surroundings) at the preset fixed bit rate. Consequently, the conventional audio encoding method is undesirable in terms of effective utilization of transmission lines. That is, though it would suffice to transmit audio signals at a low bit rate during quiet and noisy periods, the prior art is such that transmission of audio code data at a variable bit rate cannot be done, thereby making transmission at a low bit rate impossible. In a case where the overall bit rate of the apparatus is held low, it is preferred that the bit rate of an audio signal having little importance be suppressed and the bit rate of important video be raised correspondingly. However, such audio encoding at a variable bit rate cannot be carried out by the conventional audio encoding method.

SUMMARY OF THE INVENTION

Accordingly, an object of the present invention is to raise the transmission efficiency of a transmission line by making possible audio encoding at a variable bit rate and suppressing the bit rate of an audio signal having little importance.

Another object of the present invention is to raise the transmission efficiency of a transmission line by suppressing the bit rate of an audio signal in quiet intervals.

Another object of the present invention is to suppress audio bit rate by preventing the occurrence of large quantization noise below a predetermined MNR value and allowing only the occurrence of small quantization noise above this MNR value.

A further object of the present invention is to so arrange it so that a sudden change in bit rate will not give an odd impression in a case where audio encoding is carried out at a variable bit rate.

Still another object of the present invention is to raise the transmission efficient of a transmission line by suppressing the transmission efficiency of a transmission line by suppressing the bit rate of an audio signal in noisy intervals.

In accordance with a first aspect of the present invention, the foregoing objects are attained by providing an audio encoding apparatus for splitting an audio signal into a plurality of bands, allocating a number of quantization bits to each band and transmitting an audio signal of each band upon quantizing the audio signal by the number of allocated bits, comprising (1) NNR calculation means for calculating an MNR for each band, where NNR is the ratio of an audio masking level M to a quantization noise level N, (2) MNR setting means for setting a lower-limit value of the MNR, (3) means for comparing the set lower-limit value of MNR with a minimum MNR from among the Ms of the respective bands, (4) means for incrementing the number of quantization bits of the band that corresponds to the minimum MNR if the minimum MNR is smaller than the set lower-limit value of MNR, (5) bit allocation means for controlling calculation of the MNR of each band, comparison of the minimum NNR and set lower-limit value of MNR and bit allocation for allocating a quantization bit to the band having the minimum MNR until the minimum MNR becomes equal to or greater than the set lower-limit value of MNR, and terminating bit allocation control for allocating a quantization bit when the minimum MNR becomes equal to or greater than the set lower-limit value of MNR, (6) quantization means for quantizing the audio signal of each band by the number of quantization bits allocated, and (7) bit-rate deciding means for deciding a bit rate for transmission of audio data taking into account the number of quantization bits allocated to each band.

Thus, in accordance with the audio encoding apparatus of the present invention, it will suffice to allocate a number of quantization bits to each band until the MNR values in all bands become equal to or greater than the set MNR, and quantize the audio signal of each band by the allocated number of quantization bits. In accordance with the invention, therefore, it is no longer necessary to allocate a large number of quantization bits to each band when the audio signal is a quiet or near quiet signal, thus making it possible to improve transmission efficiency. In addition, when an audio signal is reproduced on the decoder side, the occurrence of large quantization noise below a set MNR value is prevented and such quantization noise can no longer be heard.

Further, the audio signal encoding apparatus is provided with means (a psychoacoustic model) to which an audio signal is input for calculating an SMR for each band, where SMR is the ratio of audio signal level S to the audio masking level M. The MNR calculation means is provided with a table for storing SNRs mapped to numbers of quantization bits, where SNR is the ratio of the audio signal level S to the quantization noise level N. The MNR calculation means obtains, from the table, an SNR that corresponds to a number of quantization bits allocated to a prescribed band and subtracts the SMR of the corresponding band from this SNR to thereby calculate the MNR of this band. This makes it possible to calculate the MNR in simple fashion.

During execution of processing for allocating numbers of quantization bits, the bit allocation means performs monitoring to determine whether a bit rate, which has been obtained using the total number of bits allocated to each of the bands thus far, has changed from the bit rate of a preceding frame by an amount greater than a set value, and terminates bit allocation processing when the bit rate has changed from the bit rate of the preceding frame by an amount greater than the set value. The quantization means quantizes the audio signal of each band by the number of quantization bits that were allocated to each band up to termination of bit allocation processing. As a result of this arrangement, the bit rate changes smoothly rather than suddenly. This makes it possible to avoid sudden changes in sound quality or tone and eliminate odd sounds caused thereby.

In accordance with a second aspect of the present invention, the foregoing objects are attained by providing an audio encoding apparatus for splitting an audio signal into a plurality of bands, allocating a number of quantization bits to each band and transmitting an audio signal of each band upon quantizing the audio signal by the number of allocated bits, comprising (1) first means for allocating a number of quantization bits to each band at a fixed bit rate and quantizing the audio signal of each band by the allocated number of quantization bits, (2) second means for allocating a number of quantization bits to each band at a variable bit rate and quantizing the audio signal of each band by the allocated number of quantization bits, (3) background noise detecting means for detecting background noise, and (4) means for allocating number of quantization bits and quantizing the audio signal of each band by the allocated number of quantization bits using the first means upon fixing the bit rate at a low rate when background noise has occurred, and allocating number of quantization bits and quantizing the audio signal of each band by the allocated number of quantization bits using the second means upon making the bit rate variable when background noise has not occurred.

Thus, in accordance with this audio encoding apparatus, the transmission efficiency of the transmission line can be improved by suppressing the bit rate of the audio signal in noisy intervals.

By adopting an arrangement the same as that of the first aspect of the invention for the second means which performs quantization at the variable bit rate, it will suffice to allocate a number of quantization bits to each band until the MNR values in all bands become equal to or greater than the set MNR, and quantize the audio signal of each band by the allocated number of quantization bits. In accordance with the invention, therefore, it is no longer necessary to allocate a large number of quantization bits to each band when the audio signal is a quiet or near quiet signal, thus making it possible to improve transmission efficiency. Further, in this case, bit allocation processing is terminated when the bit rate varies from the bit rate of the preceding frame by a wide margin, and the audio signal of each band is quantized by the number of quantization bits that were allocated to each band up to termination of bit allocation processing. As a result of this arrangement, the bit rate changes smoothly rather than suddenly. This makes it possible to avoid sudden changes in sound quality or tone and eliminate odd sound produced thereby.

Other features and advantages of the present invention will be apparent from the following description taken in conjunction with the accompanying drawings.

BRIEF DESCRIPTION OF THE DRAWINGS

FIG. 2 is a diagram showing an SNR calculation table;

FIG. 3 is a diagram showing a bit-rate calculation table (in case of a sampling frequency of 48 kHz);

FIG. 5 is a diagram useful in describing average MNR value versus an input white noise signal according to the prior art;

FIG. 6 is a diagram useful in describing average MNR value versus an input sine wave signal according to the prior art;

DESCRIPTION OF THE PREFERRED EMBODIMENTS (A) First embodiment (a) Encoding apparatus of the present invention FIG. 1 is a diagram illustrating the construction of an encoding apparatus according to the present invention. The encoder includes a band splitting filter 31 for splitting an input audio signal into data of n frequency bands (e.g., n=32 subbands), and a psychoacoustic model 32 constituted by an FFT analyzer. The psychoacoustic model 32 obtains the masking threshold value characteristic MTC' (FIG. 12) whenever audio signals of m samples per frame (m=32×36=1152) enter, and calculates the SMR for every subband from the masking level M and signal level S in each subband sbi of the masking threshold value characteristic MTC'. The SMR is the ratio of signal level S to masking level M and is measured in decibels, obtained by 10 log(S/M). The encoder further includes a bit allocator 33 for allocating the quantization bit count Bi to each band sbi (i=0–31) in accordance with bit allocation processing, described later. The bit allocator 33 calculates the MNR of each band based upon the SMR of each band sbi output by the psychoacoustic model 32 and increments the quantization bit count of the band corresponding to the smallest MNR. In this case, the SNR in Equation (1) is found from an SNR calculation table, which is illustrated in FIG. 2. More specifically, SNR is mapped to the number of quantization bits to form a table and the particular SNR that corresponds to the number of quantization bits of a band of interest is found from the table. The bit allocator 33 performs calculation of the MNR of each band, comparison of the smallest MNR with the set MNR and allocation control for allocating quantization bits to the band having the smallest MNR until the smallest MNR among the MNRs of all bands becomes equal to or greater than the set MNR (i.e., until the MNRs of all bands become equal to or greater than the set MNR), and terminates control for allocation of quantization bits when the smallest MNR has become equal to or greater than the set MNR.

An MNR retaining unit 34 retains the lower-limit value of the set MNR (this lower-limit value shall be referred to as the "set MNR" below). This unit prevents the occurrence of large quantization noise below a predetermined MNR value and, if quantization noise above this MNR value is allowed, establishes this MNR value as the set MNR. A bit-rate calculating unit 35 decides a bit rate for audio data transmission taking into account the number of quantization bits allocated to each band sbi (i=0–31) in the period of one frame. FIG. 3 shows a bit-rate calculation table in a case where the sampling frequency is 48 kHz. This table stores a mapping of bit rate (kbps) to number of bits per frame. The bit-rate calculating unit 35 obtains the total number of bits in one frame and, using the bit-rate calculation table, decides a prescribed bit rate from among the 14 bit rates available. If we let A represent the number of bits per frame, Fs (kHz) the sampling frequency, Br (kbps) the bit rate and 32×36 the number of items of sample data in one frame, then the following equation is established:

Figure 1:
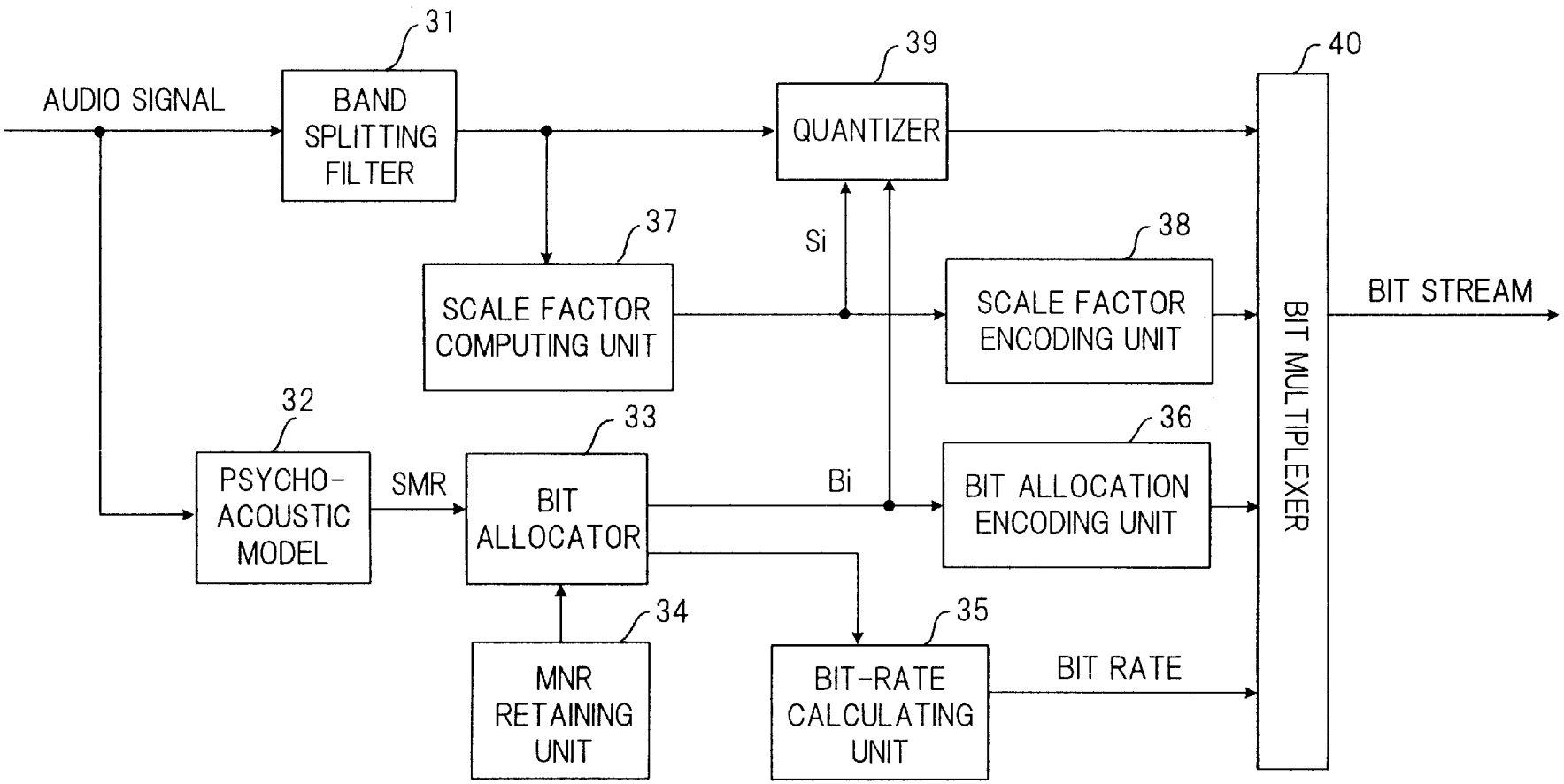
FIG. 1 is a diagram showing the construction of an audio encoding apparatus according to a first embodiment of the present invention.

$$A = \text{bit rate} \times \text{frame length} \qquad (2)'$$
$$= Br \times (32 \times 36 / Fs)$$

Accordingly, the bit rate can be found from the following equation without using the bit-rate calculation table:

$$Br = A/(32 \times 36/Fs) = A \cdot Fs/1152 \qquad (3)$$

For example, if Fs=48 kHz holds and the total number A of quantization bits in one frame is 1152, then the bit rate will be 48 kbps according to Equation (3). This agrees with the value in the bit-rate calculation table.

With reference again to FIG. 1, the audio encoder further includes an encoding unit 36 for encoding the number of quantization bits allocated to each band, and a scale factor computing unit 37 which calculates one scale factor Si in common for 36 items of sample data in each band sbi (i=0–31). The scale factor computing unit 37 performs normalization in such a manner that the maximum values of 36 waveforms will become 1.0, and calculates this normalization scale factor as the scale factor Si. An encoding unit 38 encodes this scale factor. A quantizer 39 multiplies the 36 items of sample data in each of the bands sbi (i=0–31) by the scale factor Si and quantizes the product by the number Bi of quantization bits of the band. The quantized data, scale factor and quantization bit count that have been encoded are applied to a bit multiplexer 40, which multiplexes the bits of these inputs and transmits them as a bit stream at the bit rate obtained by the bit-rate calculating unit 35.

(b) Bit allocation processing

Figure 4:
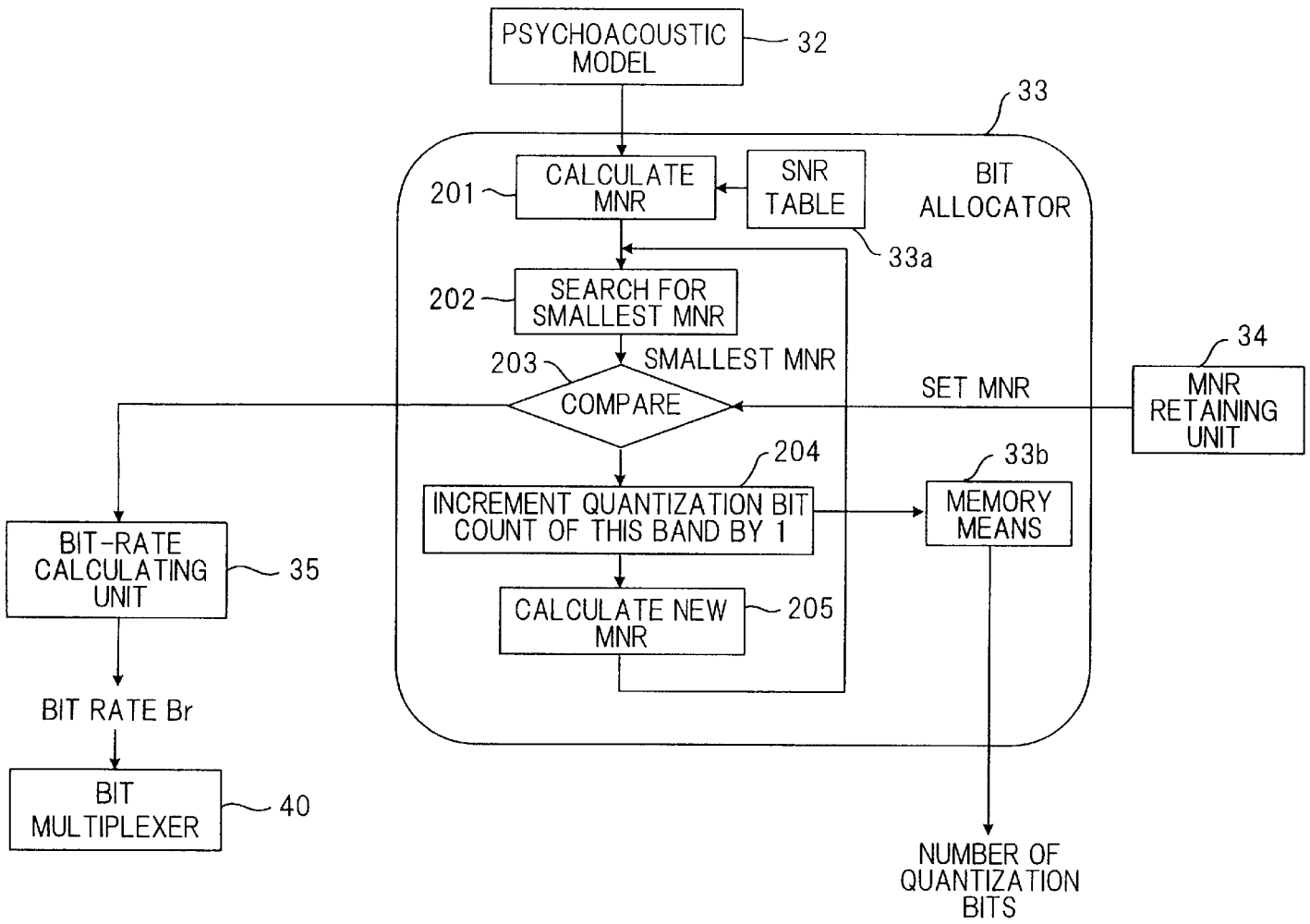
FIG. 4 is a diagram useful in describing control for bit allocation and bit rate determination according to the present invention.

FIG. 4 is a diagram useful in describing bit allocation processing according to the present invention. Components in FIG. 4 identical with those shown in FIG. 1 are designated by like reference characters. Shown in FIG. 4 are the psychoacoustic model 32, the bit allocator 33, the MNR retaining unit 34 which retains the set MNR, the bit-rate calculating unit 35 and the bit multiplexer 40.

When audio signals of m (m=32×36=1152) samples per frame enter the psychoacoustic model 32, the latter calculates the SMR value of each band sbi (i=0–31) taking into count the acoustic characteristic of the human ear. Using the calculated SMR of each band, fra the bit allocator 33 allocates bits for quantization to each band sbi (i=0–31) in accordance with the following processing: The bit allocator 33 calculates the MNR of each band sbi (i=0–31) in accordance with Equation (1) (step 201). In this case, SNR in Equation (1) is found from an SNR table 33*a* (see FIG. 2).

If the MNR of each band has been found, then the bit allocator 33 searches these MNRs for the smallest MNR (step 202) and compares the smallest MNR with the set MNR (step 203). If the smallest MNR is smaller than the set MNR, then the bit allocator 33 increments the number of quantization bits in the band having the smallest MNR (step 204). More specifically, the quantization bit count Bi is stored in memory means 33*a* for each band sbi and the quantization bit count Bi of the band sbi conforming to the smallest MNR is incremented (Bi+1→Bi).

Next, since the number of allocated quantization bits has changed, the bit allocator 33 calculates the MNR of each band again (step 205) and repeats processing from step 202 onward. In actuality, the MNR calculation processing at step 205 involves updating, by calculation, only the MNR of the band for which the number of allocated quantization bits has been incremented and not updating the MNRs of other bands.

If it is found at step 203 that the smallest MNR is equal to or greater than the set MNR, i.e., that the MNRs of all bands are equal to or greater than the set MNR, then the bit allocator 33 terminates quantization bit allocation processing and notifies the bit-rate calculating unit 35 of this fact and of the quantization bit count Bi of each band sbi (i=0–31).

In response to such notification, the bit-rate calculating unit 35 totals the numbers of quantization bits that have been allocated to the bands and multiplies the total value by 36 to obtain the number A of bits per frame. Next, using this bit count A per frame, the bit-rate calculating unit 35 obtains the bit rate Br from the bit-rate calculation table of FIG. 3 or calculates Br from Equation (3) and inputs Br to the bit multiplexer 40. The bit multiplexer 40 then multiplexes the bits of the quantized data, scale factor and quantization bit count that have been encoded and transmits the multiplexed bits in the form of a data stream at the entered bit rate.

(c) Difference between the present invention and the prior art

The difference between the audio encoding apparatus of the present invention and that of the prior art will be described using the following signals 1 through 7, in which 1 is a signal (indicative of a quiet state) that is almost independent of audio, 2 through 4 are signals (of different levels) representing white noise, and 5 through 7 are sine waves (of different frequencies).

Figure 16:
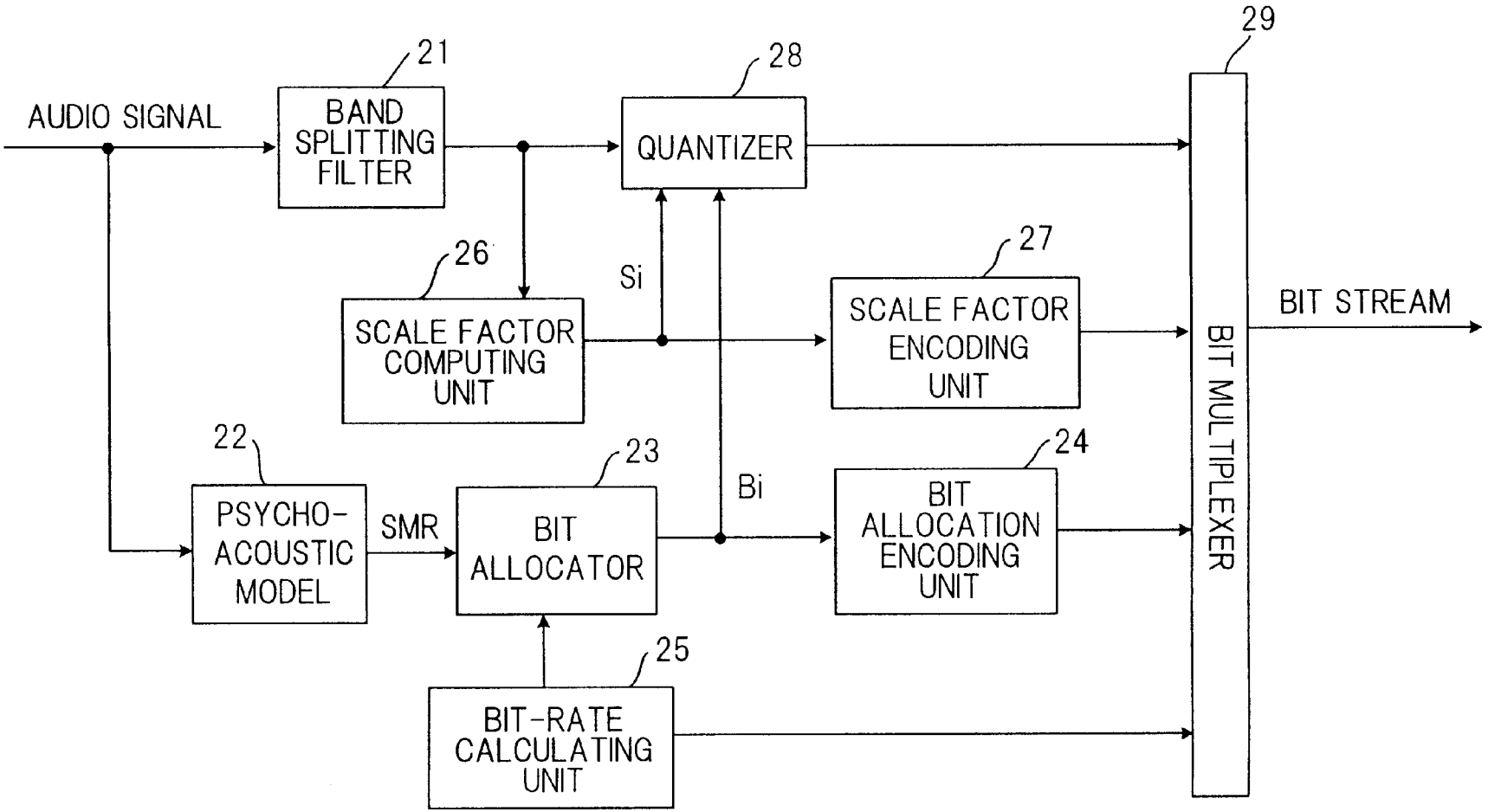
FIG. 16 PRIOR ART
FIG. 16 is a diagram showing the construction of an audio encoder according to the prior art.

1. Signal approximating almost total silence
2. White noise 1 (low level)
3. White noise 2 (medium level)
4. White noise 3 (high level)
5. 1-kHz sine wave
6. 7-kHz sine wave
7. 15-kHz sine wave If the conventional audio encoding apparatus (FIG. 16) subjects the signals 1 through 7 to audio encoding by holding the bit rate fixed at 128 kbps, the average value of smallest MNR which prevails when bit allocation has finally been decided becomes as shown in FIGS. 5 and 6 (which are based upon results of simulation).

When the smallest MNR of a signal (namely a quiet signal) that is meaningless in terms of the human sense of hearing and the MNRs of first through third white noise are compared in FIG. 5, it is seen that the lower the noise level, the larger the smallest MNR and the greater the number of quantization bits. In other words, the lower the noise level, the larger the number of quantization bits allocated. A certain amount of quantization noise is allowable. The conventional method, however, which does not take this into account, in effect uses a needlessly high bit rate. The reason for this problem encountered in the prior art is that the same bit rate is used throughout regardless of the noise level.

The present invention is so adapted that a needlessly high bit rate is not used. To accomplish this, the present invention decides the number of quantization bits so as to allow the occurrence of quantization noise up to the level N in regard to the masking level M and forbid the occurrence of quantization noise above the level N. In other words, the invention sets the MNR value, which is the ratio of the masking level M to the quantization noise level, and terminates the allocating of quantization bits when the MNRs of all bands become equal to or greater than the set MNR. If such an expedient is adopted, the number of allocated quantization bits can be reduced even in a quiet state, thereby in effect making it possible to lower the bit rate. Moreover, it can be arranged so that quantization noise above the quantization noise level conforming to the set MNR will not be produced at playback. For example, if the smallest MNR value [=10.12 (dB)] of the third white noise is made the set MNR, the allocating of quantization bits will stop when the smallest MNR of each band has exceeded the smallest MNR value [=10.12 (dB)]. As a result, the allocation of needless bits can be prevented, the bit rate can in effect be reduced and quantization noise above the third white noise level will not occur on the decoder side.

The foregoing relates to a case regarding an input white noise signal. However, the smallest MNR is dependent upon frequency as well, as illustrated in FIG. 6. Consequently, if it is desired to eliminate noise above a prescribed frequency, setting an MNR that corresponds to this frequency will make it possible to prevent allocation of needless bits, to effectively reduce the bit rate and to render inaudible noise above the above-mentioned frequency on the decoder side.

If the processing described above is executed at all times, therefore, a pseudo-variable bit rate that is in accordance with the quality of the input signal can be realized in an audio encoding apparatus that employs the high-efficiency coding of audio.

Thus, in accordance with the first embodiment, it is possible to artificially vary audio bit rate depending upon the quality (noise, silence, acoustic frequency characteristic) of the audio signal. Any extra bit rate can be assigned to video, and transmission efficiency can be improved by lowering the overall bit rate of video and audio.

(d) Modification of bit allocation control

Figure 7:
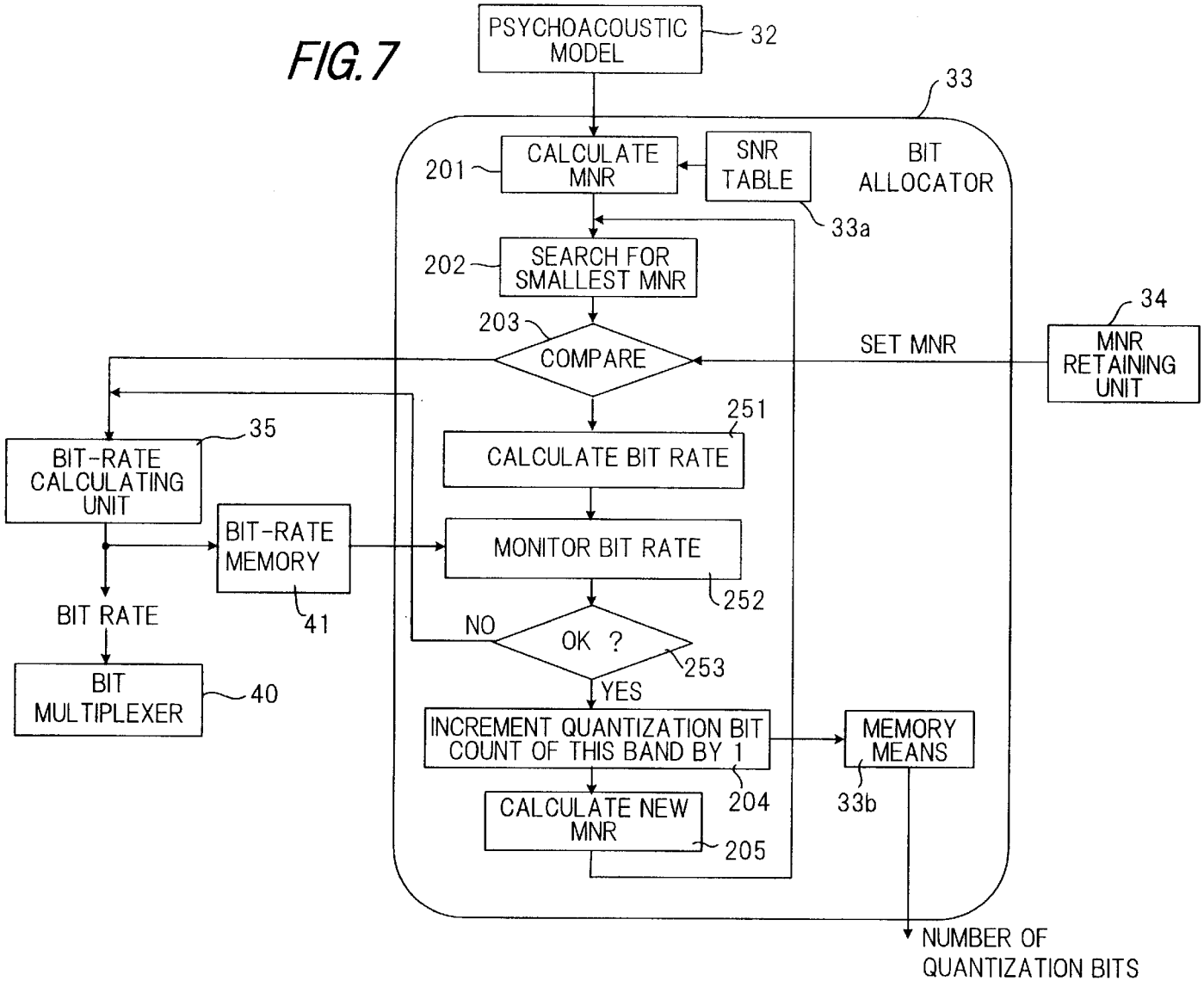
FIG. 7 is a diagram useful in describing another example of control for bit allocation and bit rate determination according to the present invention.

In a case where audio encoding of audio at a variable bit rate is performed, sound quality changes suddenly if there is a sudden change in bit rate. This can produce odd-sounding audio. Accordingly, it is necessary to vary the bit rate smoothly so as to avoid causing annoyance. FIG. 7 is a diagram useful in describing bit allocation and bit rate decision carried out so as not to cause a sudden change in bit rate. Components in FIG. 7 identical with those shown in FIG. 4 are designated by like reference characters. Numeral 41 denotes a bit rate memory for storing the bit rate of the preceding frame, where the bit rate has been calculated by the bit-rate calculating unit 35.

The processing of steps 201 through 205 is exactly the same as processing of the identically numbered steps in FIG. 4. If the smallest MNR has been found to be less than the set MNR at step 203, the bit allocator 33 calculates the total number of quantization bits allocated to the bands in the bit allocation processing executed thus far and multiplies this value by 36 to calculate the total number of bits in one frame. Next, this total bit count is used to obtain the bit rate from the bit-rate calculation table of FIG. 3 or from Equation (3) by calculation (step 251). It should be noted that the processing for calculating bit rate at step 251 can also be performed by requesting this of the bit-rate calculating unit 35.

Next, the bit rate obtained is monitored at step 252 to determine whether it has changed from the bit rate of the immediately preceding frame by more than a set amount. If the amount of change is less than the set amount (step 253), then control proceeds to step 204, where the number of quantization bits in the band having the smallest MNR is incremented. Next, since the number of allocated quantization bits has changed, the bit allocator 33 calculates the MNR of each band again (step 205) and repeats processing from step 202 onward.

If it is found at step 253 that the amount of change is greater than the set amount, then the bit allocator 33 suspends bit allocation processing and notifies the bit-rate calculating unit 35 of this fact and of the quantization bit count of each band.

In response to such notification, the bit-rate calculating unit 35 totals the numbers of quantization bits that have been allocated to the bands and multiplies the total value by 36 to obtain the number A of bits per frame. Next, using this bit count A per frame, the bit-rate calculating unit 35 obtains the bit rate from the bit-rate calculation table of FIG. 3 or calculates the bit rate from Equation (3), inputs the bit rate to the bit multiplexer 40 and stores the bit rate in the bit rate memory 41. The bit multiplexer 40 then multiplexes the bits of the quantized data, scale factor and quantization bit count that have been encoded and transmits the multiplexed bits in the form of a data stream at the entered bit rate.

If the arrangement described above is adopted, a sudden change in bit rate is eliminated, there is no sudden change in tone and no annoyance is produced.

(B) Second embodiment

Figure 8:
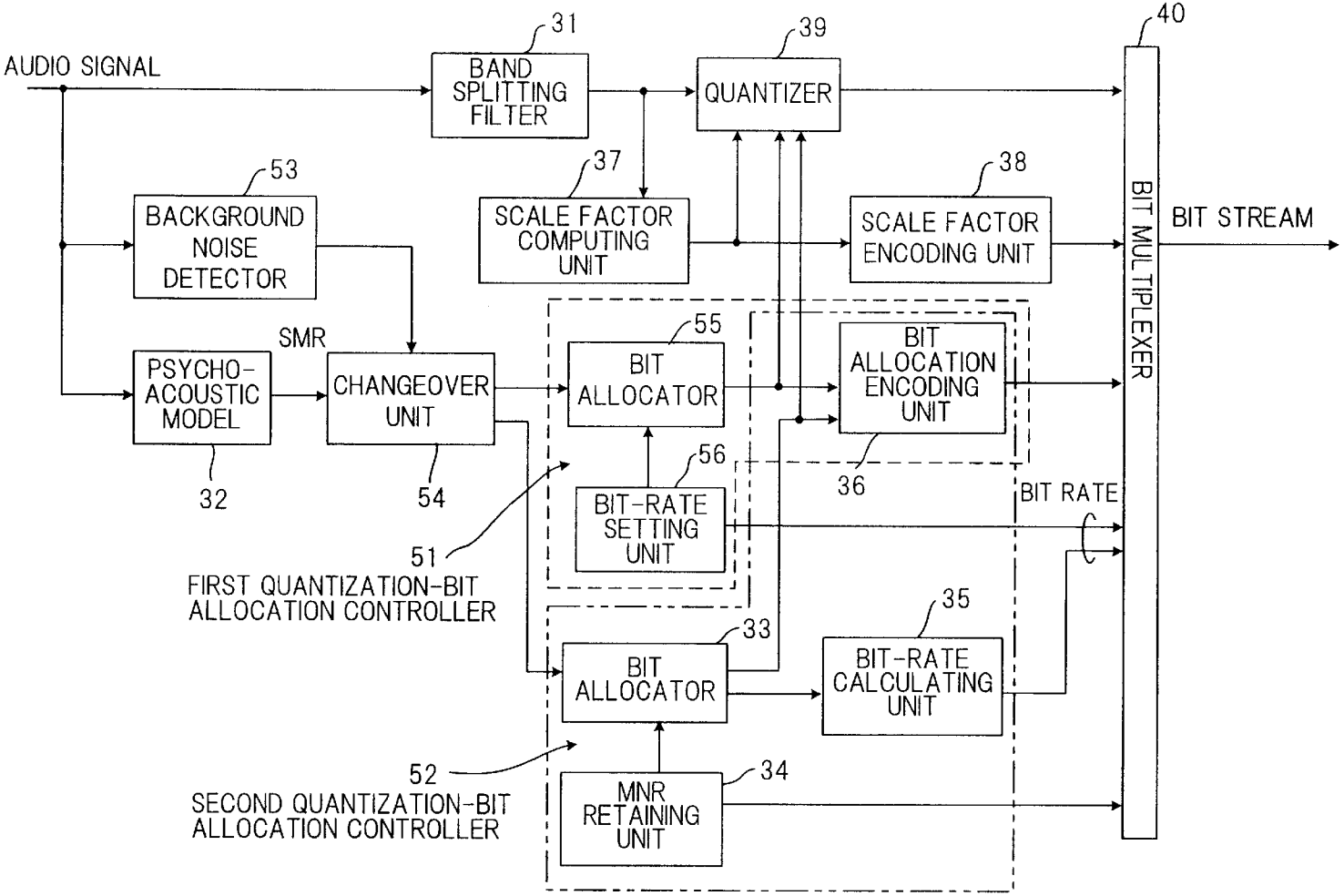
FIG. 8 is a diagram showing the construction of an audio encoding apparatus according to a second embodiment of the present invention.
Figure 17:
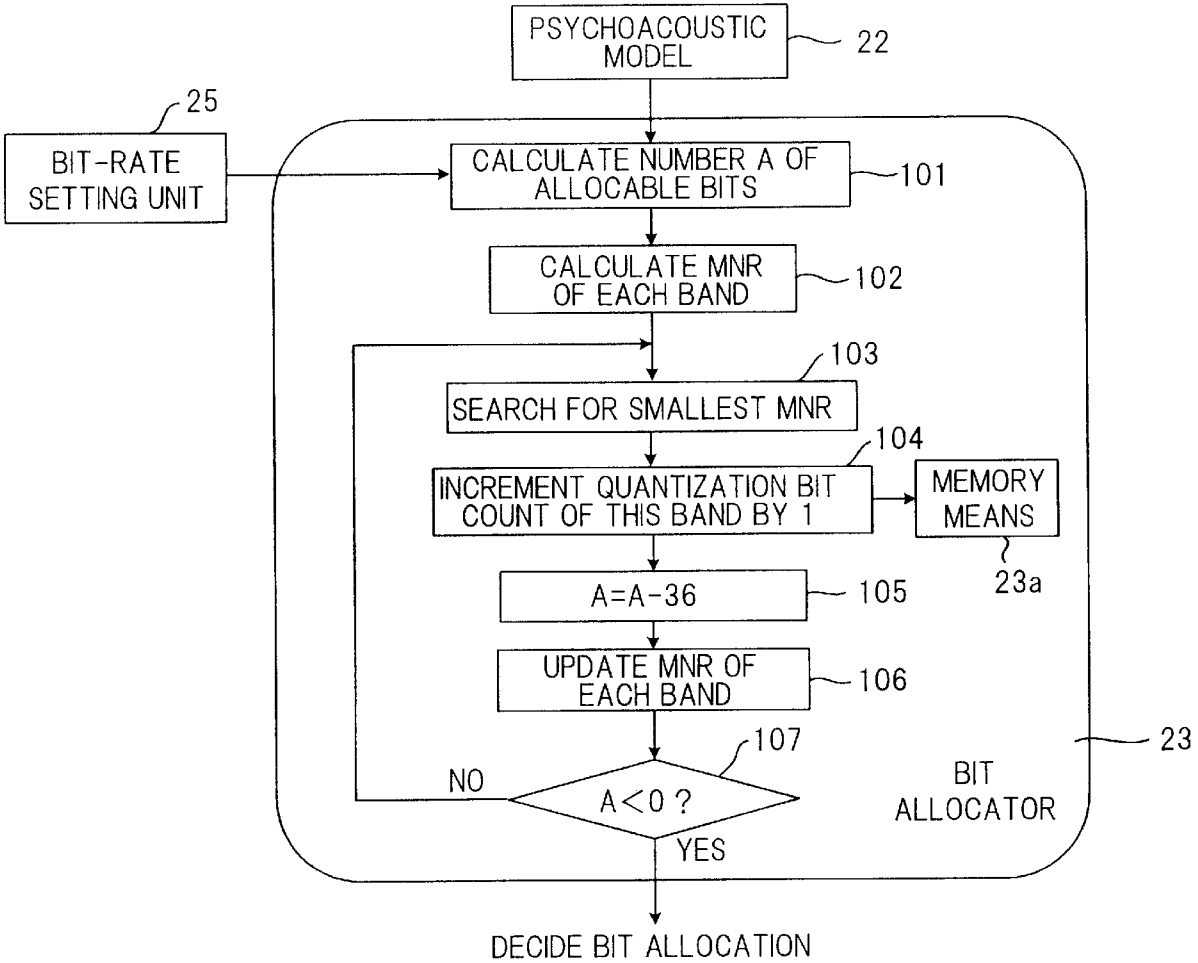
FIG. 17 PRIOR ART
FIG. 17 is a diagram useful in describing control for bit allocation performed by a bit allocator according to the prior art.

FIG. 8 is a diagram showing the construction of an audio encoding apparatus according to a second embodiment of the present invention. Components identical with those of the first embodiment shown in FIG. 1 are designated by like reference characters. According to the second embodiment, (1) quantization bits are allocated in accordance with the conventional method of FIGS. 16 and 17 when background noise is being produced, and (2) quantization bits are allocated in accordance with the method the first embodiment in FIGS. 1 and 4 when background noise is not being produced.

The encoding apparatus of FIG. 8 includes a first quantization-bit allocation controller 51 for allocating a number of quantization bits to each band at a fixed bit rate in accordance with the conventional method when background noise is being produced, a second quantization-bit allocation controller 52 for allocating a number of quantization bits to each band at a variable bit rate in accordance with the method of the first embodiment when background noise is not being produced, a background noise detector 53 for detecting background noise, and a changeover unit 54 for inputting the output of the psychoacoustic model 32 to the first quantization-bit allocation controller 51 when background noise is being produced and inputting the output of the psychoacoustic model 32 to the second quantization-bit allocation controller 52 when background noise is not being produced.

The first quantization-bit allocation controller 51 includes a bit allocator 55 for allocating a number of quantization bits to each band in accordance with the bit allocation processing of the prior art in which the bit rate is fixed, a bit-rate setting unit 56 set externally beforehand to a low bit rate for when background noise is present, and the encoding unit 36 for encoding and outputting the quantization bit count of each band. The encoding unit 36 is provided in common for the second quantization-bit allocation controller 52 as well.

The second quantization-bit allocation controller 52 includes the bit allocator 33 for allocating a number of quantization bits to each band in accordance with the bit allocation processing of the first embodiment, the MNR retaining unit 34 for retaining the set MNR, the bit-rate calculating unit 35 for deciding the bit rate based upon the quantization bit count allocated to each band, and the encoding unit 36 for encoding and outputting the quantization bit count of each band.

Figure 9:
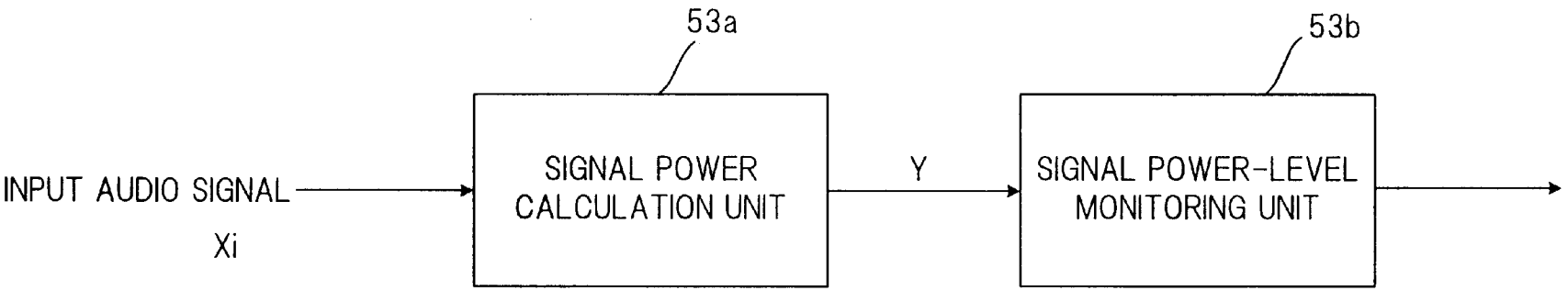
FIG. 9 is a diagram illustrating a specific embodiment of a background noise detector.

As shown in FIG. 9, the background noise detector 53 has a signal power calculation unit 53*a* and a signal power-level monitoring unit 53*b*. The signal power calculation unit 53*a* calculates the power Y of an input audio signal Xi (i=1, 2, . . . ) over a prescribed length of time in accordance with the following equation:

$$Y=\Sigma(Xi^2)\ (i=1, 2, \ldots)$$

The signal power-level monitoring unit 53*b* monitors the calculated power Y and, when power Y continues at approximately the same level for a fixed period of time (e.g., one second), judges that the signal represents background noise and outputs a signal (e.g., the high level "1") indicative of this fact. On the other hand, if it is judged that the power level represents a condition other than background noise, the signal power-level monitoring unit 53*b* outputs a signal (e.g., the low level "0") indicative of this fact.

Figure 10:
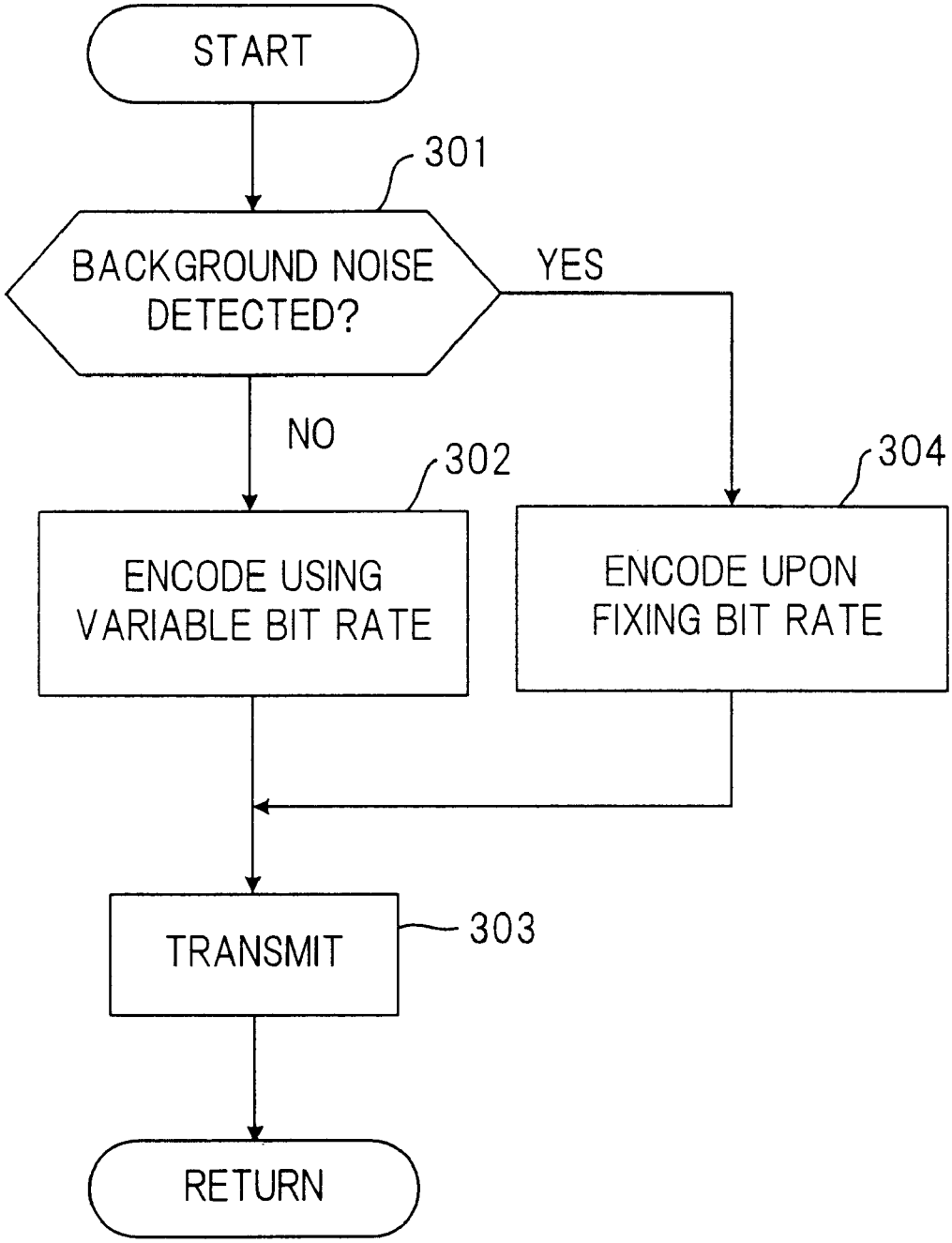
FIG. 10 is a flowchart of processing according to a second embodiment of the present invention.
Figure 11:
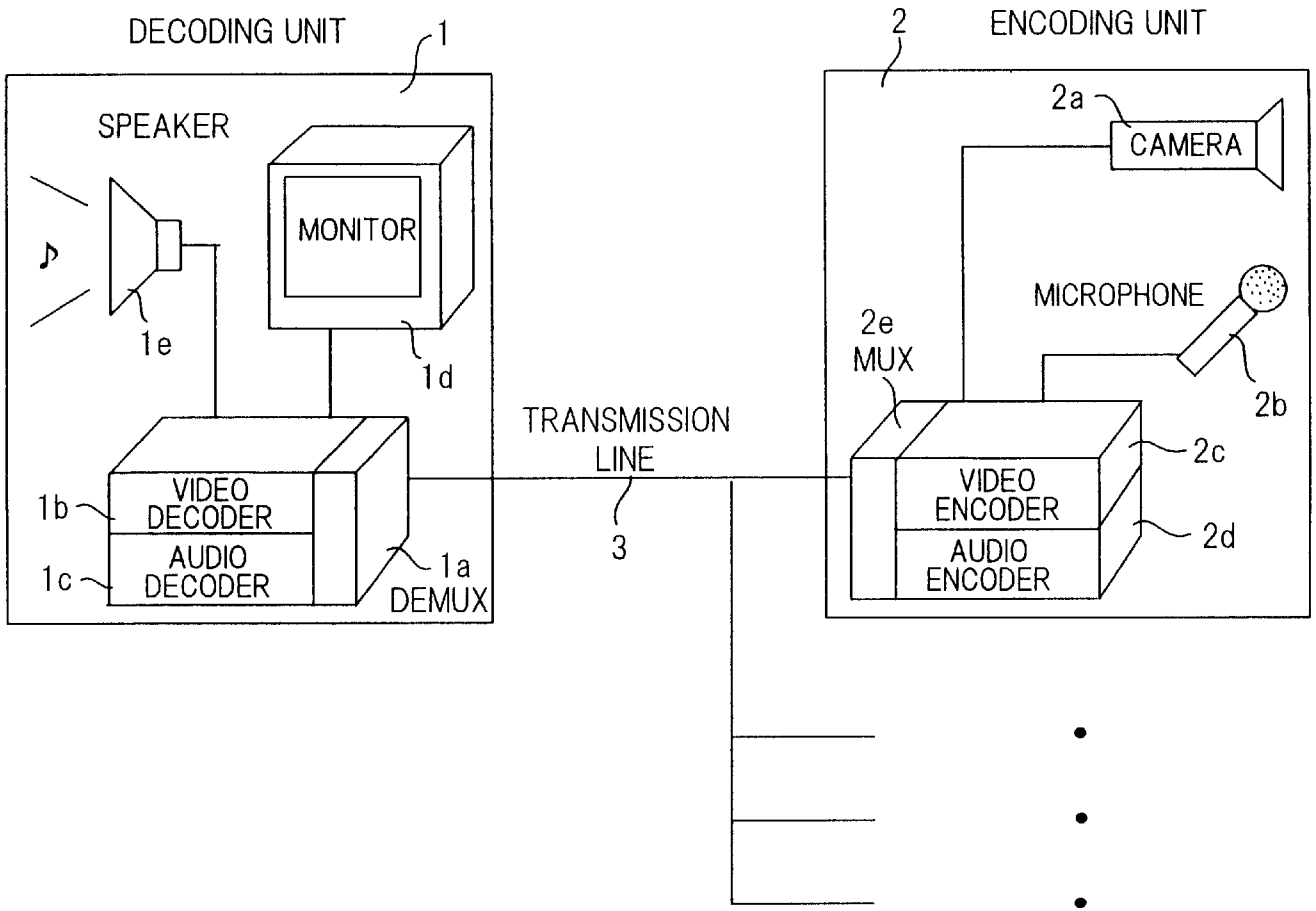
FIG. 11 PRIOR ART
FIG. 11 is a diagram showing the configuration of a remote monitoring system according to the prior art.
Figure 12:
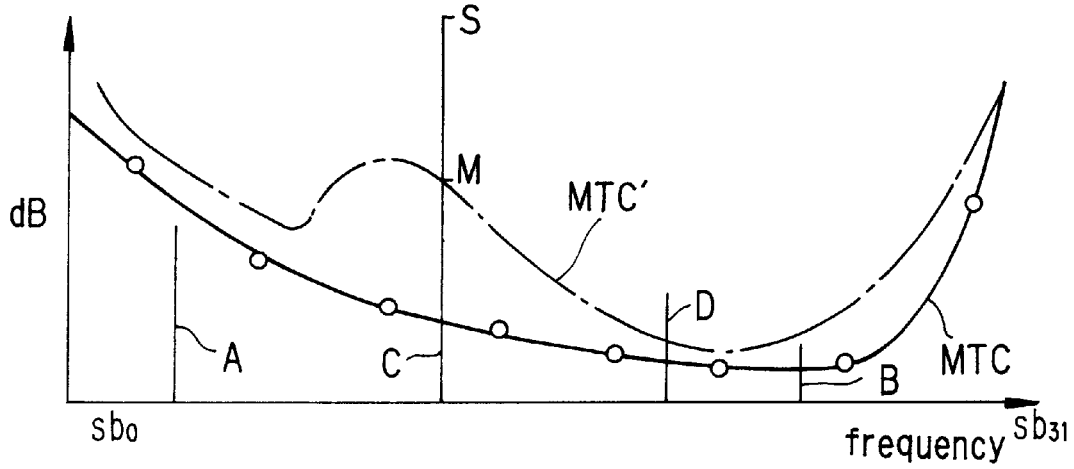
FIG.12 PRIOR ART
FIG. 12 is a diagram showing a masking threshold value characteristic according to the prior art.
Figure 13:
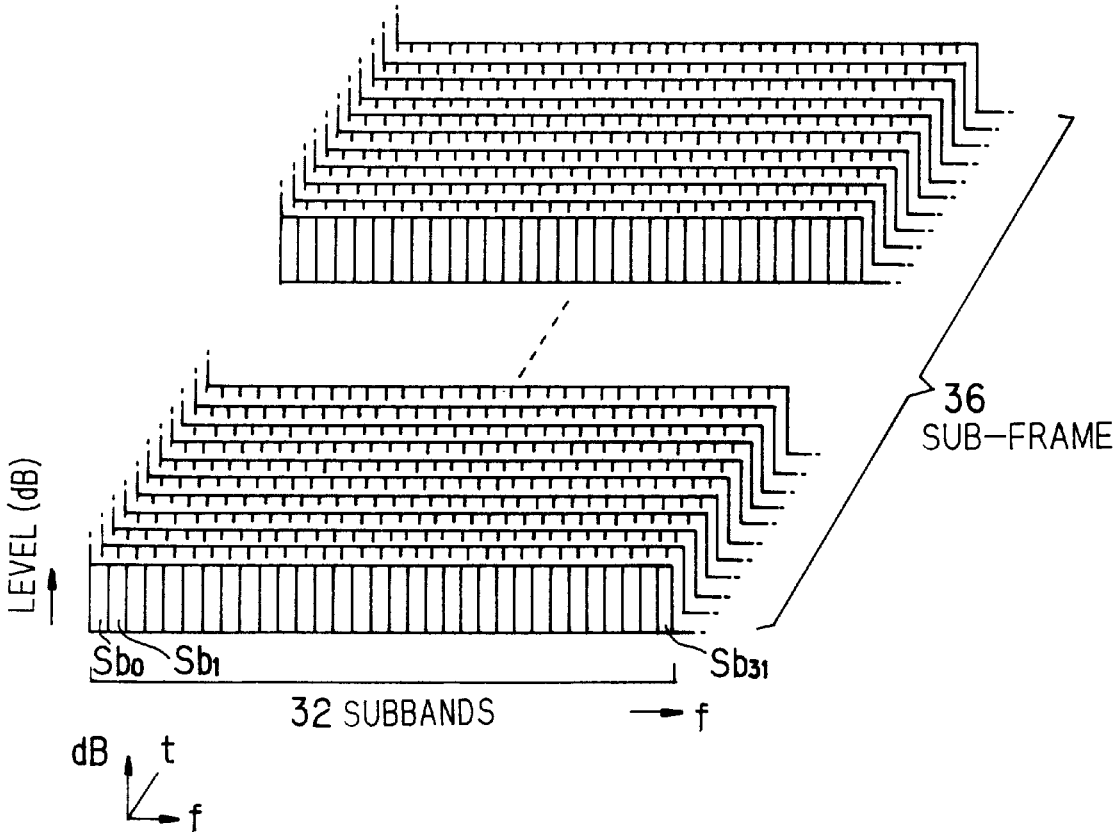
FIG.13 PRIOR ART
FIG. 13 is a diagram useful in describing the structure of a frame according to the prior art.
Figure 14:
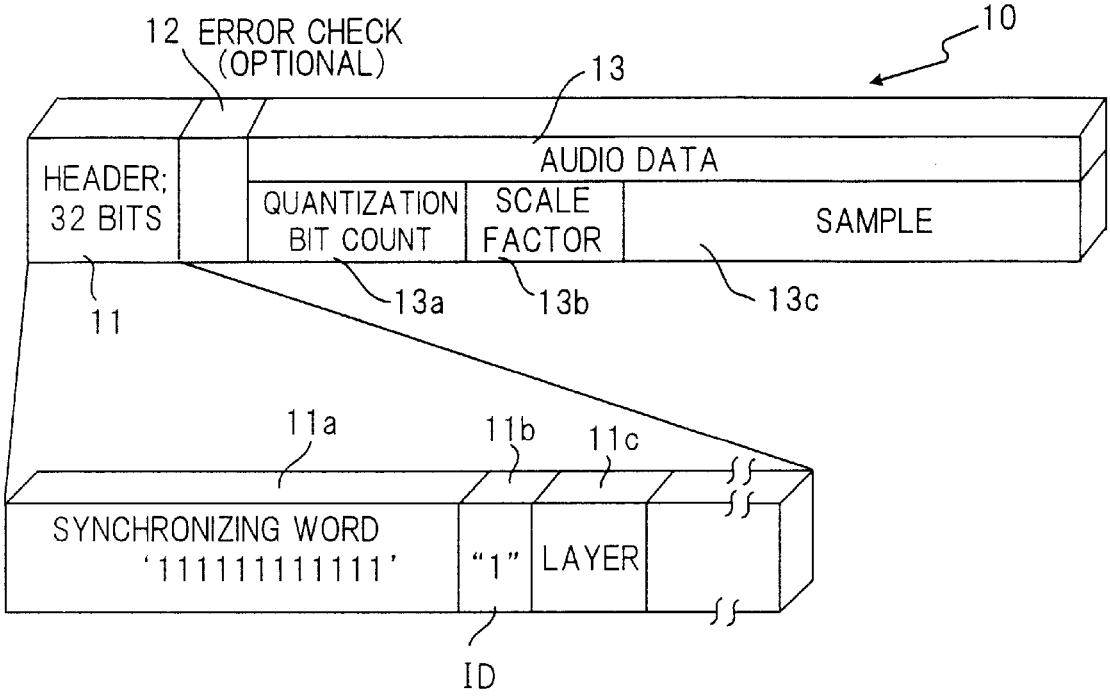
FIG. 14 PRIOR ART
FIG. 14 is a diagram useful in describing the structure of an audio bit stream according to the prior art.
Figure 15:
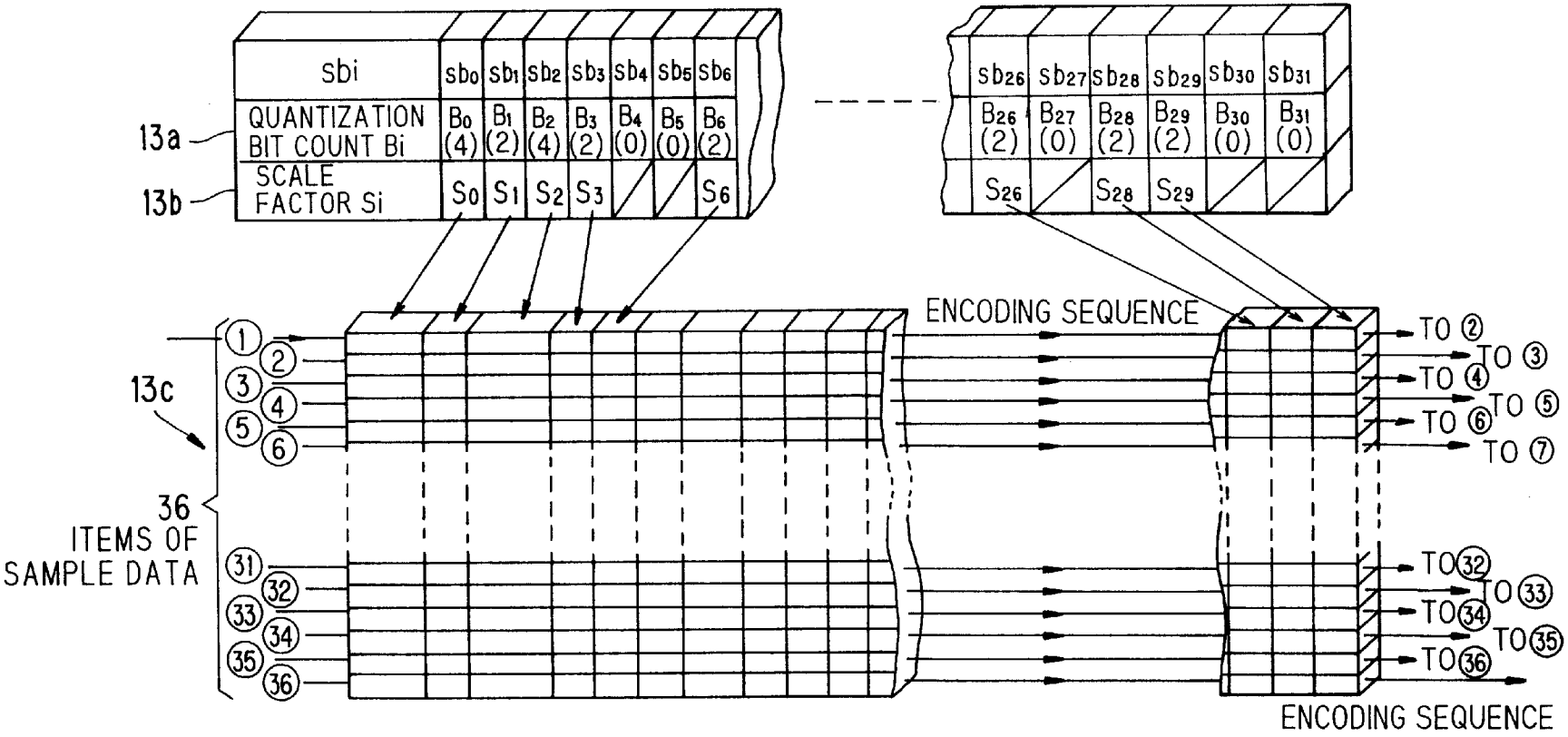
FIG. 15 PRIOR ART
FIG. 15 is a diagram showing the structure of the audio data portion of the audio bit stream.

FIG. 10 is a processing flowchart according to the second embodiment.

The background noise detector 53 detects whether or not there is background noise (step 301). If background noise has not been detected, the changeover unit 54 inputs the SMR value of each band Bs sbi (i=0–31), which has been calculated by the psychoacoustic model 32, to the second quantization-bit allocation controller 52, the latter performs bit allocation control similar to that of the first embodiment and decides the bit rate (see FIG. 4), and the quantizer 39 quantizes the audio signal of each band based upon the number of quantization bits of each band (302). The bit multiplexer 40 multiplexes the quantized data, scale factor and quantization bit count that have been encoded and transmits them as a bit stream at the bit rate calculated by the bit-rate calculating unit 35 (step 303).

If background noise has been sensed at step 301, then the changeover unit 54 inputs the SMR value of each band sbi (i=0–31), which has been calculated by the psychoacoustic model 32, to the first quantization-bit allocation controller 51. The latter allocates the number of quantization bits of each band in accordance with the conventional method of FIGS. 16, 17 based upon the noise bit rate, the quantizer 39 quantizes the audio signal of each band based upon the decided number of quantization bits of each band (304) and the bit multiplexer 40 multiplexes the quantized data, scale factor and quantization bit count that have been encoded and transmits them as a bit stream at the noise bit rate, which is the low bit rate (step 303).

Thus, in accordance with the second embodiment, an audio signal is encoded and transmitted at the noise bit rate (the low bit rate) when background noise is present, as a result of which it is possible to raise the signal transmission efficiency of the transmission line. Further, in accordance with the second embodiment, effects the same as those of the first embodiment can be obtained when there is no background noise. In other words, the bit rate of audio can be varied, surplus bit rate can be assigned to transmission of video, and transmission efficiency can be improved by lowering the overall bit rate of video and audio. By applying this method to a TV conferencing system, in which any background noise is meaningless video, and establishing a low, fixed bit rate for background noise, the associated transmission line can be utilized more effectively.

If the bit rate is changed suddenly, sound quality changes suddenly. This can result in audio that sound odd. Accordingly, the second quantization-bit allocation controller 52 is adapted to perform processing similar to that of the modification (FIG. 7) of the first embodiment, whereby the bit rate is changed smoothly to assure that an odd sound will not be produced. More specifically, during execution of processing for allocating the number of quantization bits, the second quantization-bit allocation controller 52 performs monitoring to determine whether a bit rate, which has been obtained from the total number of bits allocated to each of the bands thus far, has changed from the bit rate of the preceding frame by an amount greater than a set value, and terminates bit allocation processing when the bit rate has changed from the bit rate of the preceding frame by an amount greater than the set value. The quantizer 39 quantizes the audio signal of each band by the number of quantization bits that were allocated to each band up to termination of bit allocation processing.

In accordance with the audio encoding apparatus of the present invention, it will suffice to allocate a number of quantization bits to each band until the MM values in all bands become equal to or greater than the set MNR, and quantize the audio signal of each band by the allocated number of quantization bits. In accordance with the invention, therefore, it is no longer necessary, as in the prior art, to allocate a large number of quantization bits to each band when the audio signal is a quiet or near quiet signal, thus making it possible to improve transmission efficiency. Moreover, the occurrence of large quantization noise below a set MNR value can be prevented at reproduction on the decoding side.

Further, in accordance with the audio encoding apparatus of the present invention, the apparatus is provided with means for calculating an SMR for each band, where SMR is the ratio of audio signal level S to the audio masking level M. The MNR calculation means is provided with a table for storing SNRs mapped to numbers of quantization bits, where SNR is the ratio of the audio signal level S to the quantization noise level N. The MNR calculation means obtains, from the table, an SNR that corresponds to a number of quantization bits allocated to a prescribed band and subtracts the SMR of the corresponding band from this SNR to thereby calculate the MNR of this band. This makes it possible to calculate the MNR in simple fashion.

Further, in accordance with the audio encoding apparatus of the present invention, during execution of processing for allocating the numbers of quantization bit, the bit allocation means performs monitoring to determine whether a bit rate, which has been obtained using the total number of bits allocated to each of the bands thus far, has changed from the bit rate of a preceding frame by an amount greater than a set value, and terminates bit allocation processing when the bit rate has changed from the bit rate of the preceding frame by an amount greater than the set value. The quantization means quantizes the audio signal of each band by the number of quantization bits that were allocated to each band up to termination of bit allocation processing. This makes it possible to avoid sudden changes in sound quality or tone and eliminate odd sounds caused thereby.

Further, in accordance with the audio encoding apparatus of the present invention, transmission efficiency of a transmission line can be improved by suppressing the bit rate of an audio signal when background noise is present.

Further, in accordance with the audio encoding apparatus of the present invention, it suffices when there is no background noise to allocate a number of quantization bits to each band until the MNR value in each band becomes equal to or greater than a set MNR, and quantize the audio signal of each band by the allocated number of quantization bits. As a result, in accordance with the invention, therefore, it is no longer necessary, as in the prior art, to allocate a large number of quantization bits to each band in the quiet state, thus making it possible to improve transmission efficiency. When the bit rate changes from the bit rate of the preceding frame by more that a set value in this case, bit allocation processing is terminated and the audio signal of each band is quantized by the number of quantization bits that were allocated to each band by the time of termination of bit allocation. This makes it possible to avoid sudden changes in sound quality or tone and eliminate odd sound produced thereby.

As many apparently widely different embodiments of the present invention can be made without departing from the spirit and scope thereof, it is to be understood that the invention is not limited to the specific embodiments thereof except as defined in the appended claims.

What is claimed is:

1. An audio encoding apparatus for splitting an audio signal into a plurality of bands, allocating a number of quantization bits to each band and transmitting an audio signal of each band upon quantizing the audio signal by the number of allocated bits, comprising:

MNR calculation means for calculating an MNR for each band, where MNR is the ratio of an audio masking level M to a quantization noise level N;

MNR setting means for setting a lower-limit value of the MNR;

means for comparing the set lower-limit value of MNR with a minimum MNR from among the MNRs of the respective bands;

means for incrementing the number of quantization bits of the band that corresponds to the minimum MNR if the minimum MNR is smaller than the set lower-limit value of MNR;

bit allocation means for controlling calculation of the MNR of each band, comparison of the minimum MNR and set lower-limit value of MNR and bit allocation for allocating a quantization bit to the band having the minimum MNR until the minimum MNR becomes equal to or greater than the set lower-limit value of MNR, and terminating bit allocation control for allocating a quantization bit when the minimum MNR becomes equal to or greater than the set lower-limit value of MNR;

quantization means for quantizing the audio signal of each band by the number of quantization bits allocated; and bit-rate deciding means for deciding a bit rate for transmission of audio data taking into account the number of quantization bits allocated to each band.

2. The apparatus according to claim 1, further comprising means for calculating an SMR of each band, where SMR is the ratio of audio signal level S to the audio masking level M;

wherein said MNR calculation means has a table for storing SNRs mapped to numbers of quantization bits, where SNR is the ratio of the audio signal level S to the quantization noise level N, said MNR calculation means obtaining, from said table, an SNR that corresponds to a number of quantization bits allocated to a prescribed band and subtracts the SMR of the corresponding band from this SNR to thereby calculate the M of this band.

3. The apparatus according to claim 1, wherein said bit allocation means performs monitoring, during execution of processing for allocating the number of quantization bits, to determine whether a bit rate, which has been obtained using the total number of bits allocated to each of the bands thus far, has changed from the bit rate of a preceding frame by an amount greater than a set value, and terminates bit allocation processing when the bit rate has changed from the bit rate of the preceding frame by an amount greater than the set value, and said quantization means quantizes the audio signal of each band by the number of quantization bits that were allocated to each band up to termination of bit allocation processing.

4. An audio encoding apparatus for splitting an audio signal into a plurality of bands, allocating a number of quantization bits to each band and transmitting an audio signal of each band upon quantizing the audio signal by the number of allocated bits, comprising:

first means for allocating a number of quantization bits to each band at a fixed bit rate and quantizing the audio signal of each band by the allocated number of quantization bits;

second means for allocating a number of quantization bits to each band at a variable bit rate and quantizing the audio signal of each band by the allocated number of quantization bits; and background noise detecting means for detecting background noise;

wherein when background noise is present, the bit rate is fixed at a low rate and said first means allocates the number of quantization bits and quantizes the audio signal of each band by the allocated number of bits, and when background noise is not present, the bit rate is made variable and said second means allocates the number of quantization bits and quantizes the audio signal of each band by the allocated number of bits.

5. The apparatus according to claim 4, wherein said second means includes:

MNR calculation means for calculating an MNR for each band, where MNR is the ratio of an audio masking level M to a quantization noise level N;

MNR setting means for setting a lower-limit value of the MNR;

means for comparing the set lower-limit value of MNR with a minimum MNR from among the MNRs of the respective bands;

means for incrementing the number of quantization bits of the band that corresponds to the minimum MNR if the minimum MNR is smaller than the set lower-limit value of MNR;

bit allocation means for controlling calculation of the MNR of each band, comparison of the minimum MNR and set lower-limit value of MNR and bit allocation for allocating a quantization bit to the band having the minimum MNR until the minimum MNR becomes equal to or greater than the set lower-limit value of MNR, and terminating bit allocation control for allocating a quantization bit when the minimum MNR becomes equal to or greater than the set lower-limit value of MNR;

quantization means for quantizing the audio signal of each band by the number of quantization bits allocated; and bit-rate deciding means for deciding a bit rate for transmission of audio data taking into account the number of quantization bits allocated to each band.

6. The apparatus according to claim 5, wherein said bit allocation means performs monitoring, during execution of processing for allocating the number of quantization bits, to determine whether a bit rate, which has been obtained using the total number of bits allocated to each of the bands thus far, has changed from the bit rate of a preceding frame by an amount greater than a set value, and terminates bit allocation processing when the bit rate has changed from the bit rate of the preceding frame by an amount greater than the set value, and said quantization means quantizes the audio signal of each band by the number of quantization bits that were allocated to each band up to termination of bit allocation processing.

* * * * *